United States Patent [19]

Nedelcu

[11] Patent Number: 4,831,800

[45] Date of Patent: May 23, 1989

[54] BEAM WITH AN EXTERNAL REINFORCEMENT SYSTEM

[76] Inventor: Lucian I. Nedelcu, 10 Textbook Ave., Rocky Hill, Conn. 06067

[21] Appl. No.: 65,896

[22] Filed: Jun. 24, 1987

[51] Int. Cl.[4] ..... E04C 3/26

[52] U.S. Cl. ..... 52/225; 52/729; 52/223 R

[58] Field of Search ..... 52/723, 724, 725, 223 L, 52/225, 223 R, 729, 732, 89, 87

[56] References Cited

U.S. PATENT DOCUMENTS

| | | | |
|---|---|---|---|
| 339,296 | 4/1886 | Jackson | 52/225 X |
| 366,839 | 7/1887 | Jackson | 52/225 |
| 375,999 | 1/1888 | Jackson | 52/225 |
| 940,326 | 11/1909 | Kaspar | 52/87 |
| 3,140,764 | 7/1964 | Cheskin | 52/223 R X |
| 3,164,928 | 1/1965 | Sarros | 52/89 X |

FOREIGN PATENT DOCUMENTS

| | | | |
|---|---|---|---|
| 164961 | 9/1955 | Australia | 52/225 |
| 660989 | 11/1960 | Italy | 52/729 |

*Primary Examiner*—Henry E. Raduazo
*Assistant Examiner*—Creighton Smith

[57] ABSTRACT

A longitudinally extending beam having a concrete upper flange, a web rigidly extending transversely downward from the upper flange along its length, and an arched portion extending between the spaced apart leg portions on the web. A rigid reinforcement member external to the beam spans the arched portion between the leg portions. Means are associated with each leg portion for connecting one end of the reinforcement member to the other whereby when there is transverse load on the girder, the reinforcement member is stressed longitudinally. When a transverse load is applied to the beam, the reinforcement member cooperates with developing an eccentrically compressive force reducing the bending moment on the arched beam.

4 Claims, 2 Drawing Sheets

BEAM WITH AN EXTERNAL REINFORCEMENT SYSTEM

BACKGROUND OF THE INVENTION

The present invention is generally related to a concrete or composite concrete beam with an external reinforcement system, in order to improve the response of the beam to external forces, reduce the weight of the beam, and eliminated crack formation in the concrete.

Known methods of constructing a reinforced beam, have as their objective the improvement of the response of the beam to the external forces, hence the capacity of the beam. There are two main methods of constructing a reinforced beam. According to the first alternative method, the capacity of the beam is improved by means of an internal reinforcement sytsem. In this method the beam is made of an anisotropic material, concrete for instance, to take compression, and it is reinforced with an internal reinforcement, steel for instance, to take tension.

According to the second alternative method, the capacity of the beam is improved by introducing an internal stress in the beam, of such magnitude and distribution, to counteract the expected forces. In this method the beam can be made of any material, concrete, steel or fiberglass for instance, and the internal stresses are created by means of bars or wires, made of steel or fiberglass for instance, with a higher strength.

One disadvantage of the first method is that under the external forces, the said anisotropic material, concrete for instance, exhibits cracks under the external loads in the tension area of the beam, exposing the said internal reinforcement, steel for instance, to corrosion. A further disadvantage of the former method is that the weight of the beam is too great and the portion of the beam that is cracked does not participate to take loads, being a ballast of the beam.

The major disadvantage of the second method is that the amount of the initial stress is limited by the capacity of the beam at transfer of the force from the said bars or wires to the beam.

SUMMARY OF THE INVENTION

The present invention represents a beam to be utilized in construction, using in an efficient manner the strength of its component materials, preferably steel to take tension and concrete to take compression.

To achieve this purpose, the beam is provided with a top flange made of concrete to take compression, with an arched web to take shear, with a bottom flange made of concrete or steel if tension due to the external loads exist, and with an external reinforcement system to take tension and simultaneously to develop a compressive stress in the beam, when the external forces apply.

It is thus an objective of this invention is to develop a force in the external reinforcement system, when the external forces are applied, changing favorably the bending moment diagram of the beam, and creating at the same time a compression stress in the beam. Another objective of this invention is to reduce the weight of the beam by 30% to 40% and to reduce the bending moment the beam has to resist by 50% to 70%.

Another objective of this invention is to eliminate cracks in concrete due to the external loads.

Another objective of this invention is to reduce the amount of concrete in the beam, obtaining a beam with less time-dependent deflection since the shrinkage and creep of concrete are smaller. A further objective of this invention is to reduce the erection cost of the structure since the weight of the beam is less.

A further objective of this invention is to reduce the size of the bearings and the dimension of the substructure and their costs.

Further objectives of this invention are to extend the length of the span that can be built and to decrease the depth to span ratio of the beam.

BRIEF DESCRIPTION OF THE DRAWINGS

Other objectives and advantages of this invention will become more apparent from the specification taken in conjunction with the accompanying drawings in which.

DETAILED DESCRIPTION OF THE INVENTION

Figure 1:
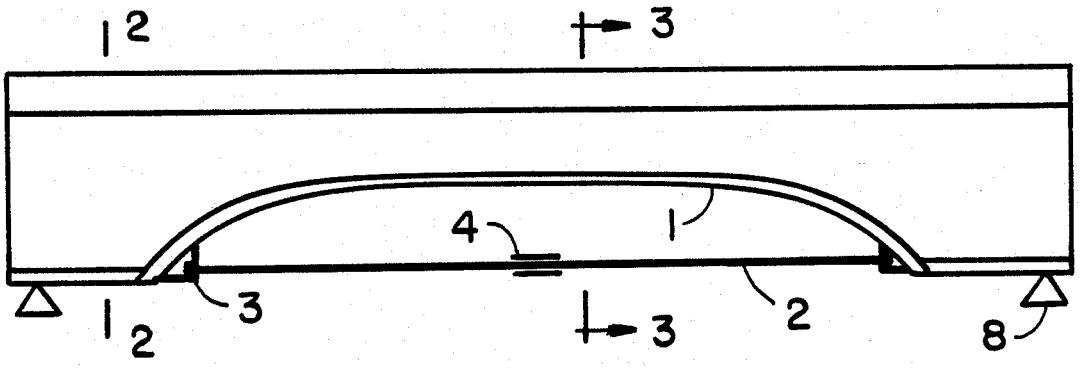
FIG. 1 represents an elevation of the beam with an external reinforcement system.

Referring to the drawing shown in FIG. 1, numeral 1 designates a beam, numeral 2 designates an external reinforcement system, numeral 3 designates a connection system between the beam and the external reinforcement system 2, capable of transferring the force from the external reinforcement system to the beam. Numeral 4 designates an optional device for prestressing the external reinforcement system, and numeral 8 represents the supports of the beam.

Under the influence of external forces, the beam deflects and elongates the external reinforcement system 2. A tension force is thus developed in the external reinforcement system. This tension force from the external reinforcement system 2 reduces the bending moment that acts on the beam and at the same time induces a compression stress in the beam. Having a smaller bending moment and an axial compression force created by the external reinforcement system, the beam needs a smaller cross section and the tension stress at the bottom of the beam can be smaller than the modulus of rupture if the beam is made of concrete in this zone.

Figure 2:
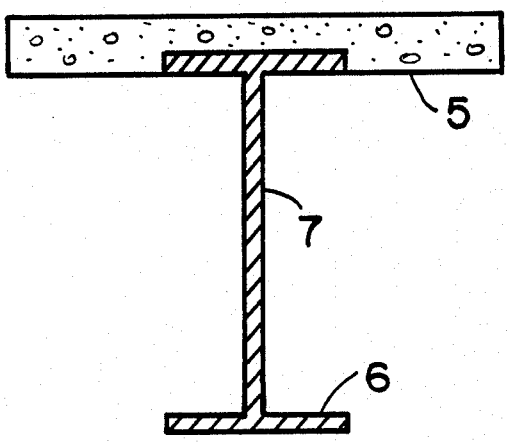
FIG. 2 represents a cross section of the beam with an external reinforcement system in the vicinity of the supports taken along the lines indicated in FIG. 1.
Figure 3:
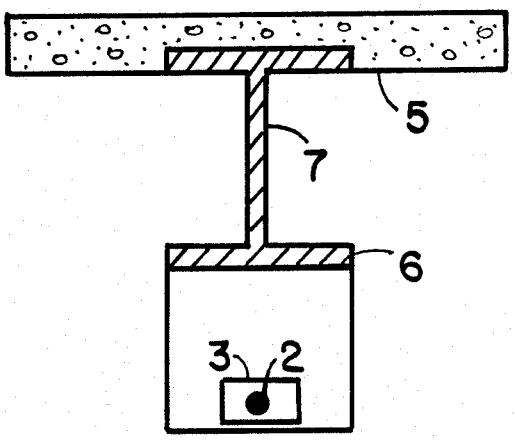
FIG. 3 represents a typical cross sectional view of the beam with an external reinforcement system taken along lines indicated in FIG. 1.

Referring also to FIG. 2 and 3, which both represent cross sections of the beam with an external reinforcement system, numeral 5 designates a top flange of the beam made of concrete, numeral 6 designates a bottom flange of the beam made of any material with a good tension strength, such as steel, reinforced concrete, or fiberglass, when tension stress in this area is allowed, and numeral 7 designates a web made of any material having the required strength to take the shear stress. The cross section of the beam in the vicinity of supports, FIG. 2, needs to be greater than the cross section of the beam at midspan, FIG. 3, in order to resist the shear force which is greater near the supports and to transfer the force from the external reinforcement system to the beam.

Figure 4:
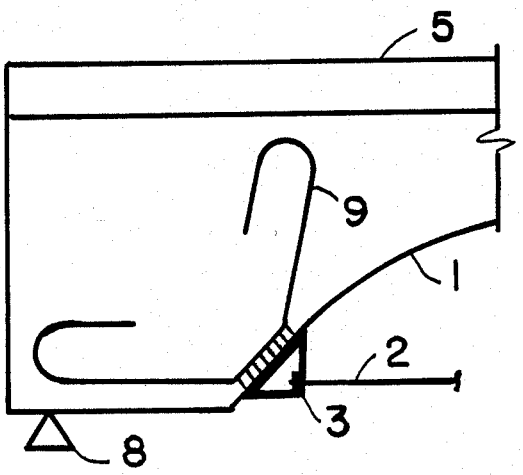
FIG. 4 represents a detail of the attachment of the external reinforcement system to the beam.

The cross section of the beam with an external reinforcement system may be of any shape and made of any material which can resist the stresses developed under the external forces. Common features of the invention are a longitudially extending beam having a concrete upper flange, a web made of any material and rigidly extending transversely downward from the upper flange along its length, and an arched portion extending between the spaced apart leg portions on the web. Rigid means external to the beam span the arched portion between the leg portions. Means are associated with each leg portion for connecting one end of the rigid means to the other whereby when there is no transverse load the girder, the rigid means is stressed longitudinally. When a transverse load is applied to the beam, the rigid means cooperates with the leg portions developing a eccentrically compressive force reducing the bending moment on the arched beam. Referring to the drawing shown in FIG. 4, numeral 9 designates the internal reinforcement needed for a concrete web in the vicinity of the connection system, numeral 3; the reinforcement 9 is not needed if the web is made of either steel or fiberglass.

Figure 5:
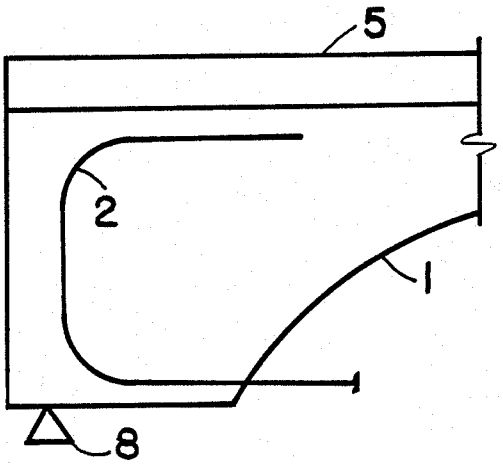
FIG. 5 represents a detail of an alternative attachment of the external reinforcement system to the beam.

Referring to the drawing shown if FIG. 5, the transfer of the force from the external reinforcement system, when the web is made of concrete, may be through the adhesion forces that exist between concrete and an extension of the reinforcement 2, i.e., steel or fiberglass for instance.

Figure 6:
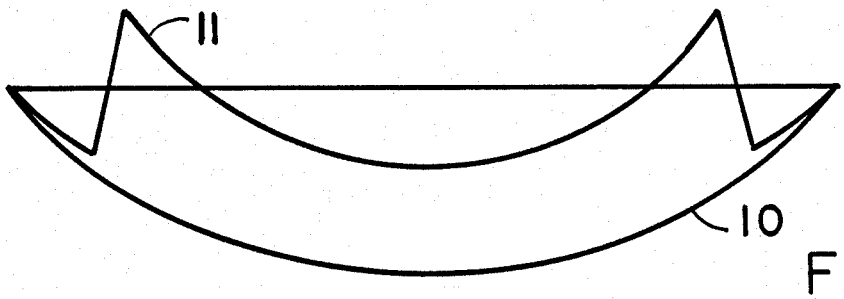
FIG. 6 represents the bending moment diagram of the beam with an external reinforcement system versus the bending moment of a normal beam.

Referring to the drawing shown in FIG. 6, numeral 10 designates the bending moment diagram for the beam without an external reinforcement system, and numeral 11 designates the bending moment diagram for the beam with an external reinforcement system. For a common loading situation, the bending moment of the beam with an external reinforcement system is up to four times less than the beam without an external reinforcement system.

Figure 7:
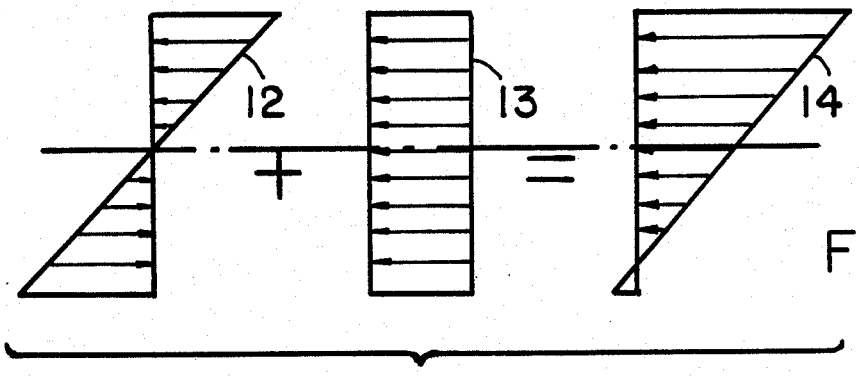
FIG. 7 represents the stress diagrams for the beam with an external reinforcement system.

FIG. 7 represents the stress diagrams of the beam with an external reinforcement system at midspan, and numeral 12 represents the stress diagram due to the bending moment, numeral 13 represents the stress diagram due to axial force developed by the external reiforcement system, and numeral 14 represents the final stress diagram.

Since the form from the external reinforcement system generates a compressive stress in the beam with an external reinforcement system, it follows that the beam with an external reinforcement system, can be made entirely of concrete and there will be no cracks in the concrete due to the external forces.

Figure 8:
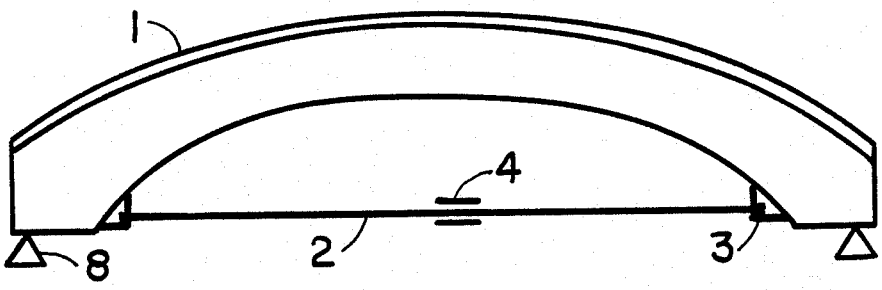
FIG. 8 represents the beam with an external reinforcement system having a curved top flange, for roofs for instance.

FIG. 8 represents a beam with an external reinforcement system having a curved top flange that could be used for roofs or bridges.

Figure 9:
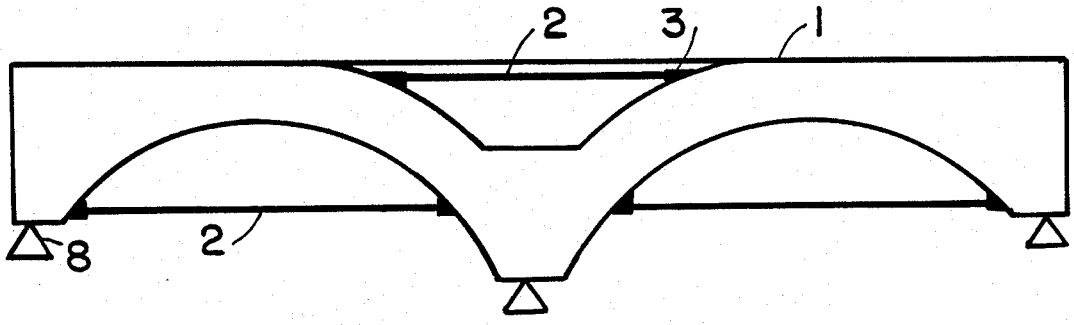
FIG. 9 represents a continuous structure using the beam with an external reinforcement system.

FIG. 9 represents schematically a continuous structure using the beams with an external reinforcement system.

The invention is not limited exclusively to the embodiments illustrated. Modifications can be made in the form, the disposition, and the nature of some of the elements used in carrying out the invention, provided that these modifications do not conflict with the provisions contained in each of the following claims.

I claim:

1. A girder member comprising:

a longitudinally extending beam having a concrete upper flange, a web made of a material having greater tensile strength than concrete and rigidly connected to the upper flange with shear connectors , the web extending transversely downward from the upper flange and having longitudinally spaced appart leg portions with an intermediate arched portion extending between the leg portions;

rigid means external to the beam and spanning the arched portion between leg portions;

means associated with each leg portion for rigidly connecting one end of the rigid means to the one leg portion;

whereby when a load is applied to the beam the rigid means undergoes tensional stress and thereby cooperates with the leg portions to reduce the bending moment on the arched portion of the beam.

2. The girder member of claim 1, wherein the upper flange and the web are both formed from concrete.

3. The girder member of claim 2, wherein the beam further includes a lower flange extending longitudinally along the web at least on the web leg portions.

4. The girder member of claim 3, wherein the rigid means further includes a prestressing device for introducing initial compression stresses in upper concrete flange.

* * * * *